US008628406B1

(12) United States Patent
Gibase et al.

(10) Patent No.: US 8,628,406 B1
(45) Date of Patent: Jan. 14, 2014

(54) SYSTEMS AND METHODS FOR IMPLEMENTING KENO-TYPE WAGERING GAMES AND RELATED PROMOTIONS

(75) Inventors: Chris Gibase, Henderson, NV (US); Dennis Frey, Las Vegas, NV (US)

(73) Assignee: Boyd Gaming Corporation, Las Vegas, NV (US)

( * ) Notice: Subject to any disclaimer, the term of this patent is extended or adjusted under 35 U.S.C. 154(b) by 1452 days.

(21) Appl. No.: 11/738,301

(22) Filed: Apr. 20, 2007

Related U.S. Application Data

(60) Provisional application No. 60/796,064, filed on Apr. 28, 2006.

(51) Int. Cl.
*A63F 9/24* (2006.01)

(52) U.S. Cl.
USPC ..... 463/25; 463/18; 463/20

(58) Field of Classification Search
USPC ..... 463/16, 17, 18, 20, 43, 25
See application file for complete search history.

(56) References Cited

U.S. PATENT DOCUMENTS

| | | | | |
|---|---|---|---|---|
| 5,909,875 | A | 6/1999 | Weingardt | |
| 6,102,400 | A | 8/2000 | Scott et al. | |
| 6,270,407 | B1 | 8/2001 | Dodge | |
| 6,315,290 | B1 | 11/2001 | Roethel et al. | |
| 6,364,313 | B1 | 4/2002 | Moody | |
| 6,425,823 | B1 | 7/2002 | Byrne | |
| 6,447,395 | B1 | 9/2002 | Stevens | |
| 6,685,563 | B1 * | 2/2004 | Meekins et al. | 463/25 |
| 6,811,486 | B1 * | 11/2004 | Luciano, Jr. | 463/24 |
| 6,824,465 | B2 | 11/2004 | Luciano, Jr. | |
| 2001/0036855 | A1 * | 11/2001 | DeFrees-Parrott et al. | 463/17 |
| 2002/0063387 | A1 | 5/2002 | Timpano | |
| 2002/0077174 | A1 * | 6/2002 | Luciano et al. | 463/25 |
| 2003/0017867 | A1 | 1/2003 | deKeller | |
| 2003/0034605 | A1 | 2/2003 | Hunter et al. | |
| 2003/0073480 | A1 | 4/2003 | Thomas et al. | |
| 2003/0224847 | A1 | 12/2003 | Jaimet | |
| 2004/0053668 | A1 * | 3/2004 | Baerlocher | 463/18 |
| 2004/0192428 | A1 | 9/2004 | Byrne | |
| 2004/0259629 | A1 | 12/2004 | Michaelson et al. | |
| 2006/0084490 | A1 | 4/2006 | Khal | |
| 2006/0100008 | A1 * | 5/2006 | Wright et al. | 463/17 |

OTHER PUBLICATIONS

"Keno Download Center," http://www.keno-info.com/keno_download.html, pp. 1-4.
"Progressive Keno," http://wizardofodds.com/keno/kenoapx4.html, pp. 1-2.
"Power Keno," http://wizardofodds.com/keno/kenoapx6.html, pp. 1-3.

* cited by examiner

*Primary Examiner* — Damon Pierce
(74) *Attorney, Agent, or Firm* — Austin Rapp & Hardman

(57) ABSTRACT

A method for implementing a Keno-type wagering game may involve providing game tickets. Each game ticket may include a plurality of numbers. The method may also involve receiving completed game tickets from participating players. Each completed game ticket may include a player selection of a certain quantity of the plurality of numbers. The method may also involve holding a drawing in which multiple numbers are chosen. The method may also involve providing payouts to winning players based on how closely the players' number selections on the game tickets match the numbers chosen in the drawing. At least one number chosen in the drawing may be a bonus number that has greater value than other numbers chosen in the drawing.

22 Claims, 7 Drawing Sheets

546

546A

| 6 | BALLS |
|---|---|
| FROM | 40 |

| 6 | SPOTS |
|---|---|
| EDGE | 7.10% |

| | Catch | Probability | Prize | Ret % | Total Payout % | Hit Rate | Pr x $Pr^2$ | Sum | Prob x Prize | Sum | Std. Dev. | Edge % |
|---|---|---|---|---|---|---|---|---|---|---|---|---|
| R W W W W B | 6 | 0.00003% | $100,000 | 2.61% | 2.61% | 3,838,380.00 | 2605.266 | 2605.266 | 0.026 | 0.026 | 51.042 | 97.39% |
| R W W B | 5 | 0.00177% | $1,500 | 2.66% | 5.26% | 56,446.76 | 39.861 | 2645.126 | 0.027 | 0.053 | 51.431 | 94.74% |
| R W W B | 4 | 0.05481% | $200 | 10.96% | 16.22% | 1,824.54 | 21.923 | 2667.050 | 0.110 | 0.162 | 51.643 | 83.78% |
| R B | 2 | 6.04109% | $3 | 18.12% | 34.35% | 16.55 | 0.544 | 2667.050 | 0.162 | 51.643 | 0.162 | 65.65% |
| R W W W W | 5 | 0.00177% | $1,000 | 1.77% | 36.12% | 56,446.76 | 17.716 | 2684.765 | 0.018 | 51.661 | 3.989 | 63.88% |
| R W W W | 4 | 0.05481% | $100 | 5.48% | 41.60% | 1,824.54 | 5.481 | 2690.246 | 0.055 | 51.716 | 3.966 | 58.40% |
| R | 1 | 21.74792% | $1 | 21.75% | 63.35% | 4.60 | 0.217 | 2690.246 | 51.716 | 3.966 | 51.716 | 36.65% |
| W W W W B | 5 | 0.00177% | $1,000 | 1.77% | 65.12% | 56,446.76 | 17.716 | 2707.962 | 0.018 | 3.983 | 51.885 | 34.88% |
| W W W B | 4 | 0.05481% | $100 | 5.48% | 70.60% | 1,824.54 | 5.481 | 2713.443 | 0.055 | 4.038 | 51.934 | 29.40% |
| B | 1 | 21.74792% | $1 | 21.75% | 92.35% | 4.60 | 0.217 | 2713.443 | 4.038 | 51.934 | 4.038 | 7.65% |
| W W W W | 4 | 0.05481% | $10 | 0.55% | 92.90% | 1,824.54 | 0.055 | 2713.498 | 0.005 | 51.939 | 3.974 | 7.10% |

FIG. 5A

SYSTEMS AND METHODS FOR IMPLEMENTING KENO-TYPE WAGERING GAMES AND RELATED PROMOTIONS

RELATED APPLICATIONS

This application is related to and claims priority from U.S. Patent Application Ser. No. 60/796,064 filed Apr. 28, 2006, for "Systems And Methods For Playing A Modified Keno Game," with inventors Chris Gibase and Dennis J. Frey, which is incorporated herein by reference.

TECHNICAL FIELD

The present disclosure relates generally to gaming and gaming-related technology. More specifically, the present disclosure relates to systems and methods for implementing Keno-type wagering games and related promotions.

BACKGROUND

Gaming (sometimes referred to as gambling) generally involves placing a wager on various possible random outcomes or combinations of outcomes in hopes of winning a reward (typically money). A popular recreational activity, gaming is enjoyed by many people around the world.

A casino is a facility that accommodates gaming activities. Casinos are typically combined with hotels and may offer other forms of entertainment in addition to gaming. For example, casinos may include restaurants, live entertainment events (e.g., boxing, concerts, etc.), retail shopping, and so forth. Casino administrators are constantly searching for new, unique, and interesting ways to attract patrons. Some casinos offer promotions that provide incentives for players to participate in gaming activities.

Keno is a popular game that is played in many casinos. In a conventional Keno game, each participating player chooses anywhere from 1 to 20 numbers and marks them on a game ticket of 80 numbers (1 to 80). A drawing is then held in which 20 numbers are drawn at random. Each winning player is paid out against his/her original wager based on how many of the numbers that are drawn match the numbers that the player marked on his/her game ticket.

Slot machines are another popular attraction in casinos. One type of slot machine is a mechanical device that includes a number of spinning reels and a payline. Another type of slot machine is a computing device that includes a display screen. On this type of slot machine, the "reels" and the "payline" may be images that are displayed on the display screen. Typically, the goal when playing a slot machine is to spin the reels (either the mechanical reels or the images of reels on the video display) so that the symbols on all of the reels line up on the payline (either a physical payline or an image of a payline on a video display) in a winning combination. When a player achieves a winning combination in this manner, the player may win a payout. The amount of the payout may be determined by a payout table, which may be posted on the front of the slot machine or displayed on the display screen.

BRIEF DESCRIPTION OF THE DRAWINGS

FIG. 5A illustrates another example of a payout table that may be defined for a Keno-type wagering game as disclosed herein;

DETAILED DESCRIPTION

Figure 1:
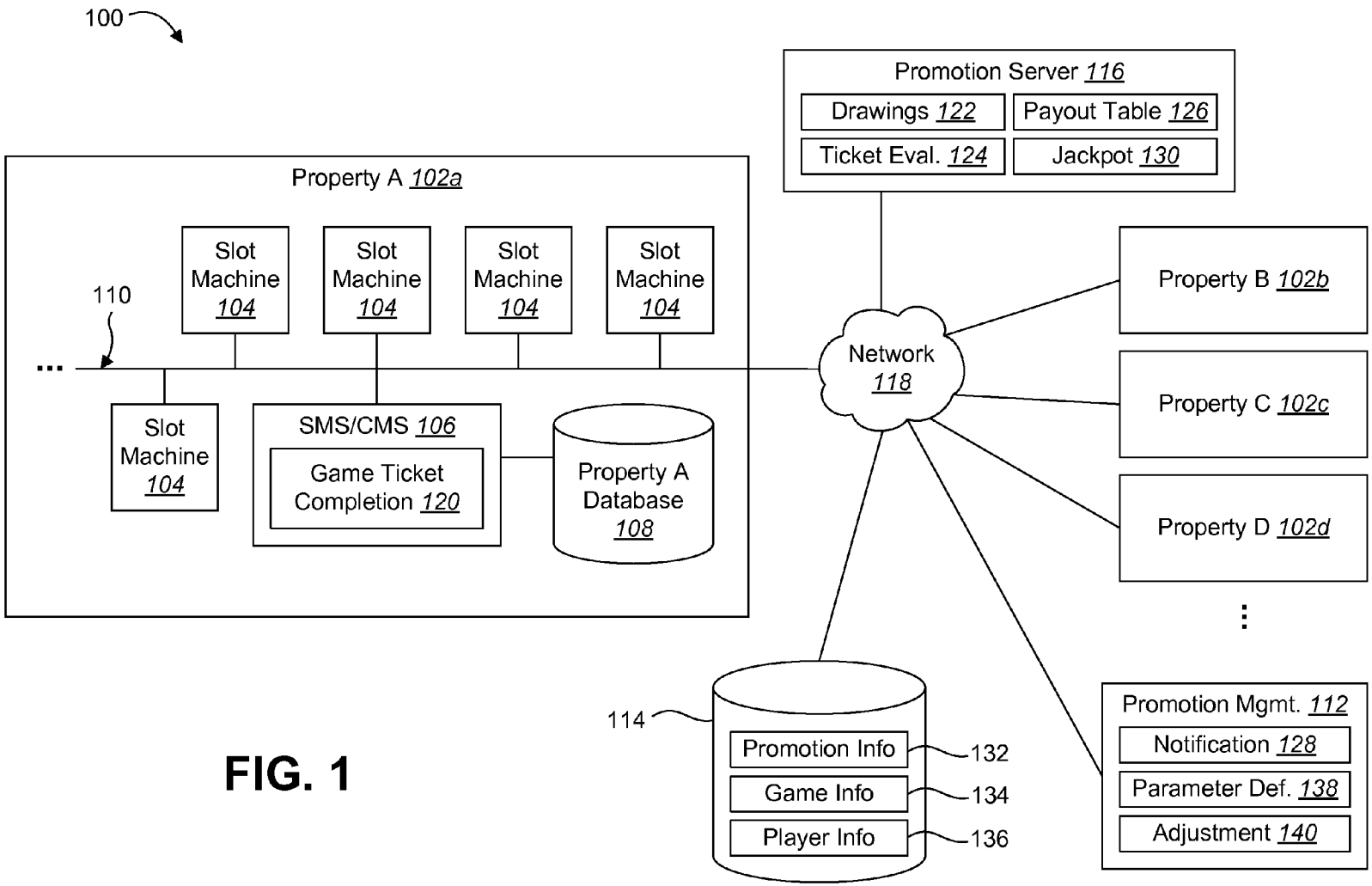
FIG. 1 illustrates an example of a system that may be used to implement a promotion for slot machine players that utilizes the Keno-type wagering game concept disclosed herein.

A method for implementing a Keno-type wagering game is disclosed. The method may involve providing game tickets. Each game ticket may include a plurality of numbers. The method may also involve receiving completed game tickets from participating players. Each completed game ticket may include a player selection of a certain quantity of the plurality of numbers. The method may also involve holding a drawing in which multiple numbers are chosen. The same quantity of numbers may be chosen in the drawing and selected by the participating players on the completed game tickets. The method may also involve providing payouts to winning players based on how closely the players' number selections on the game tickets match the numbers chosen in the drawing. At least one number chosen in the drawing may be a bonus number that has greater value than other numbers chosen in the drawing.

The wagering game may be played as a live Keno game. Alternatively, the wagering game may be played on a standalone slot machine. Alternatively, the wagering game may be played as a live table game.

A method for using a Keno-type wagering game as part of a promotion for slot machine players is also disclosed. The method may involve providing game tickets for the promotion. Each game ticket may include a plurality of numbers. The method may also involve receiving completed game tickets from participating players. Each completed game ticket may include a player selection of a certain quantity of the plurality of numbers. The method may also involve holding multiple drawings. In each drawing multiple numbers may be chosen. The quantity of numbers chosen in each drawing may be the same quantity of numbers that was selected by the participating players on the completed game tickets. The method may also involve providing payouts to winning players based on how closely the players' number selections on the game tickets match the numbers chosen in the drawings. In each drawing at least one bonus number may be chosen that has greater value than other numbers chosen in that drawing. The method may also involve notifying the winning players about their payouts.

The method may also involve providing players with opportunities to select numbers on the game tickets based on the players' slot machine play. For example, a player may be allowed to select one number on a game ticket each time that the player wagers a predefined amount on one or more slot machines. Alternatively, or in addition, the method may involve allowing players to purchase opportunities to select numbers on the game tickets. Players may use cash, slot machine credits, and/or reward credits (e.g., players club points) to purchase opportunities to select numbers.

The method may also involve providing a jackpot payout as part of the promotion. The jackpot payout may be provided to at least one player whose number selections match all of the numbers that are chosen during a drawing. The jackpot payout may be progressive.

The promotion may be implemented across multiple properties. Alternatively, the promotion may be implemented across a single property.

The method may involve storing information about a game ticket that a player has partially completed. The method may also involve allowing the player to continue completing the game ticket when the player resumes play. The method may also involve displaying information about how close a player is to completing a game ticket on a display screen associated with a slot machine. The method may also involve periodically deleting information about partially completed game tickets.

Several exemplary embodiments are now described with reference to the Figures. This detailed description of several exemplary embodiments, as illustrated in the Figures, is not intended to limit the scope of the claims.

The word "exemplary" is used exclusively herein to mean "serving as an example, instance or illustration." Any embodiment described as "exemplary" is not necessarily to be construed as preferred or advantageous over other embodiments.

As used herein, the terms "an embodiment," "embodiment," "embodiments," "the embodiment," "the embodiments," "one or more embodiments," "some embodiments," "certain embodiments," "one embodiment," "another embodiment" and the like mean "one or more (but not necessarily all) embodiments," unless expressly specified otherwise.

The term "determining" (and grammatical variants thereof) is used in an extremely broad sense. The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

One aspect of the present disclosure relates to a Keno-type wagering game. A Keno-type wagering game as disclosed herein may include several aspects. In one aspect, players who wish to participate in the Keno-type wagering game may obtain and complete game tickets. This may be done electronically, e.g., game tickets may be in electronic form and may be displayed on a display screen of a computing device. Alternatively, a game ticket may be printed on paper. All of the game tickets that are provided in connection with a particular game may include the same numbers. The numbers may be all of the numbers within a specified range. For example, each game ticket may include the numbers 1-40. As another example, each game ticket may include the numbers 1-80, as in a conventional Keno game.

In order to participate in a Keno-type wagering game as disclosed herein, a player may select N of the numbers on his/her game ticket, where N is an integer. Typically N is equal to or greater than 1 but less than the total quantity of numbers of the game ticket. The value of N may be the same for each player that participates in the game. In other words, each player that wants to participate in the game may select N numbers from his/her game ticket.

Another aspect of a Keno-type wagering game as disclosed herein may involve holding a drawing in which a certain quantity of numbers is chosen from among the numbers that appear on each of the game tickets. (In this context, the term "drawing" should be interpreted broadly to encompass any way in which numbers may be chosen.) The quantity of numbers chosen during the drawing may be equal to N, i.e., equal to the quantity of numbers that was selected by each of the participating players on their respective game tickets.

Another aspect of a Keno-type wagering game as disclosed herein may involve evaluating game tickets that were completed prior to the drawing and submitted for evaluation. Players may win payouts based on how closely their number selections on the game tickets match the numbers that were chosen during the drawing. For example, if N numbers are chosen, a maximum payout may be provided to a player who has chosen all N numbers correctly. Lesser payouts may be provided to players who have chosen some, but not all, of the N numbers correctly. A payout table may define how the player payouts are determined.

At least one of the numbers chosen in the drawing may be a bonus number that has greater value than other numbers chosen in the drawing. A greater payout may be provided for correctly selecting a bonus number than for correctly selecting a non-bonus number, or even for correctly selecting multiple non-bonus numbers. More than one bonus number may be provided in a drawing. For example, two bonus numbers may be provided. The first number that is chosen during the drawing may be a bonus number, and the last number that is chosen during the drawing may also be a bonus number.

There are many different ways that the Keno-type wagering game disclosed herein may be played. For example, the Keno-type wagering game may be played as a live Keno game. As another example, the Keno-type wagering game may be played as a live table game. As another example, the Keno-type wagering game may be played on a standalone slot machine.

Another aspect of the present disclosure relates to using the Keno-type wagering game concept described above as part of a promotion for slot machine players. FIG. 1 illustrates an example of a system 100 that may be used to implement such a promotion.

The promotion system 100 that is shown in FIG. 1 is shown as being implemented across multiple properties 102, which may be owned, managed, or under the control of the same organization. As used herein, the term "property" 102 may refer to any facility that includes slot machines 104 and that allows at least some patrons to play on the slot machines 104. For example, the term "property" 102 may refer to a casino. Alternatively, the term "property" 102 may refer to other types of facilities, such as restaurants, grocery stores, airports, etc. The properties 102 that are shown in FIG. 1 are property A 102*a*, property B 102*b*, property C 102*c* and property D 102*d*.

A number of slot machines 104 are shown as being included in property A 102*a*. A slot monitoring system (SMS) and a casino management system (CMS) are also shown within property A 102*a*. The SMS and CMS may be referred to collectively as an SMS/CMS system 106. Thus, a reference to the SMS/CMS system 106 may refer to the SMS, the CMS, or both the SMS and the CMS. A database 108 is also shown within property A 102*a*. The SMS/CMS system 106 is shown in electronic communication with the slot machines 104 and with the database 108 via a local area network (LAN) 110. Although not explicitly shown in FIG. 1, property B 102*b*, property C 102*c*, and property D 102*d* may be configured similarly to property A 102*a*.

The promotion system 100 of FIG. 1 is also shown with a promotion management component 112, a central database 114 and a promotion server 116. A wide area network (WAN) 118 is also shown. The WAN 118 may connect the promotion management component 112, the central database 114 and the promotion server 116 to the SMS/CMS systems 106 at the various properties 102.

As discussed above, in accordance with the Keno-type wagering game concept disclosed herein, a player may select N of the numbers on his/her game ticket. One way in which players may be allowed to select numbers on a game ticket may involve a "play-to-play" scenario. In accordance with a play-to-play scenario, players may be allowed to earn opportunities to select numbers on a game ticket via slot machine play. For example, a player may earn the opportunity to select one number on a game ticket each time that the player wagers a predefined amount on any of the slot machines 104 at the participating properties 102. An example showing how a play-to-play scenario may be implemented will be discussed below.

Another way in which players may be allowed to select numbers on a game ticket may involve a "pay-to-play" scenario. In accordance with a pay-to-play scenario, players may be allowed to purchase opportunities to select numbers on a game ticket. Players may be allowed to purchase such opportunities using cash or slot machine credits. Alternatively, or in addition, players may be allowed to purchase such opportunities using reward credits (e.g., players club points).

The SMS/CMS system 106 of property A 102*a* is shown with a game ticket completion component 120. The game ticket completion component 120 may implement the functionality of allowing players to select numbers on a game ticket. The game ticket completion component 120 may allow players to earn opportunities to select numbers on a game ticket via slot machine play. Alternatively, or in addition, the game ticket completion component 120 may allow players to purchase opportunities to select numbers on a game ticket.

As discussed above, in accordance with the Keno-type wagering game concept disclosed herein, drawings may be held. In each drawing, a certain quantity of numbers may be chosen from among the numbers that appear on each of the game tickets. In the promotion system 100 of FIG. 1, the promotion server 116 is shown with a drawings component 122. The drawings component 122 may implement the functionality of holding these types of drawings.

As discussed above, whenever a drawing is held, game tickets that were completed and submitted prior to the drawing may then be evaluated, and players may win payouts based on how closely the numbers that were selected on the game tickets match the numbers that are chosen during the drawing. The promotion server 116 is shown with a game ticket evaluation component 124. The game ticket evaluation component 124 may implement the functionality of evaluating game tickets and determining payouts for winning players. The promotion server 116 is also shown with a payout table 126 that may be used to define how these payouts are determined.

There are many ways that players who win payouts as a result of participating in a Keno-type wagering game may be notified about their payouts. For example, a notification message may be displayed to a winning player while the player is playing on a slot machine. As another example, a player may be notified about his/her winnings via email. The promotion management component 112 is shown with a notification component 128. The notification component 128 may implement the functionality of notifying winning players about their payouts.

A promotion that utilizes the Keno-type wagering concept disclosed herein may involve playing multiple Keno-type wagering games over a defined period of time. For example, a promotion may last one week, and during this time a new Keno-type wagering game may be played every 15 minutes (i.e., a new drawing may be held every 15 minutes) during the promotion, at least during certain hours of the day.

Another aspect of a promotion that utilizes the Keno-type wagering concept disclosed herein may involve a jackpot, i.e., a top prize for the promotion. A jackpot may be provided to a player who has selected each of the numbers that are chosen during a drawing. If multiple players correctly select each of the numbers that are chosen, then the jackpot may be divided among these players. The jackpot may be progressive. For example, if no player correctly selects each of the numbers that are chosen in a particular drawing, then the amount of the jackpot for the next drawing may increase by a certain amount. The promotion server 116 is shown with a jackpot component 130. The jackpot component 130 may implement the functionality of providing a jackpot.

The central database 114 is shown with promotion information 132, game information 134 and player information 136. The promotion information 132 may include information about the promotions that are held. The game information 134 may include information about the Keno-type wagering games that are played during each promotion. The player information 136 may include information about the various players that participate in the promotions and games. Some or all of the information that is stored in the central database 114 may also be stored in the databases 108 at the various properties 102.

The promotion management component 112 may be used by promotion administrators to define certain parameters for a promotion. Some examples of parameters that may be defined for a particular promotion include: the start date of the promotion, the end date of the promotion, the amount of time between drawings during the promotion, the payout table 126 that is used during the promotion, the payout configuration (discussed below) for the promotion, the starting value for the jackpot, the amount that the jackpot is incremented after each drawing where no player wins the jackpot, etc. The promotion management component 112 is shown with a parameter definition component 138. The parameter definition component 138 may implement the functionality of allowing promotion administrators to define promotion-related parameters.

As indicated, one of the parameters that may be defined for a promotion is the payout configuration. The payout that is provided to a winning player may include a mixture of non-cashable credits, cashable credits, and hand-paid funds. The parameter definition component 138 may allow promotion administrators to configure the mixture of non-cashable credits, cashable credits and hand-paid funds as desired. For example, the payout amount up to a first threshold (0 . . . X) may be non-cashable credits, the payout amount above the first threshold up to a second threshold (X+1 . . . Y) may be cashable credits, and the payout amount above the second threshold (Y+1 and above) may be hand-paid funds. Of course, it is not necessary that the payout amount always include non-cashable credits, cashable credits, and hand-paid funds. For instance, in the previous example, if it were desirable to award a player only cashable credits and hand-paid funds, then the first threshold (X) may be set to zero.

The promotion management component 112 may also be used by promotion administrators to make changes to the information that is stored in the central database 114. There are many reasons why promotion administrators may want to make these types of changes, e.g., to resolve player disputes, to award free games to certain players, etc. The promotion management component 112 is shown with an adjustment component 140. The adjustment component 140 may implement the functionality of allowing promotion administrators to make changes to the information that is stored in the central database 114.

Figure 2:
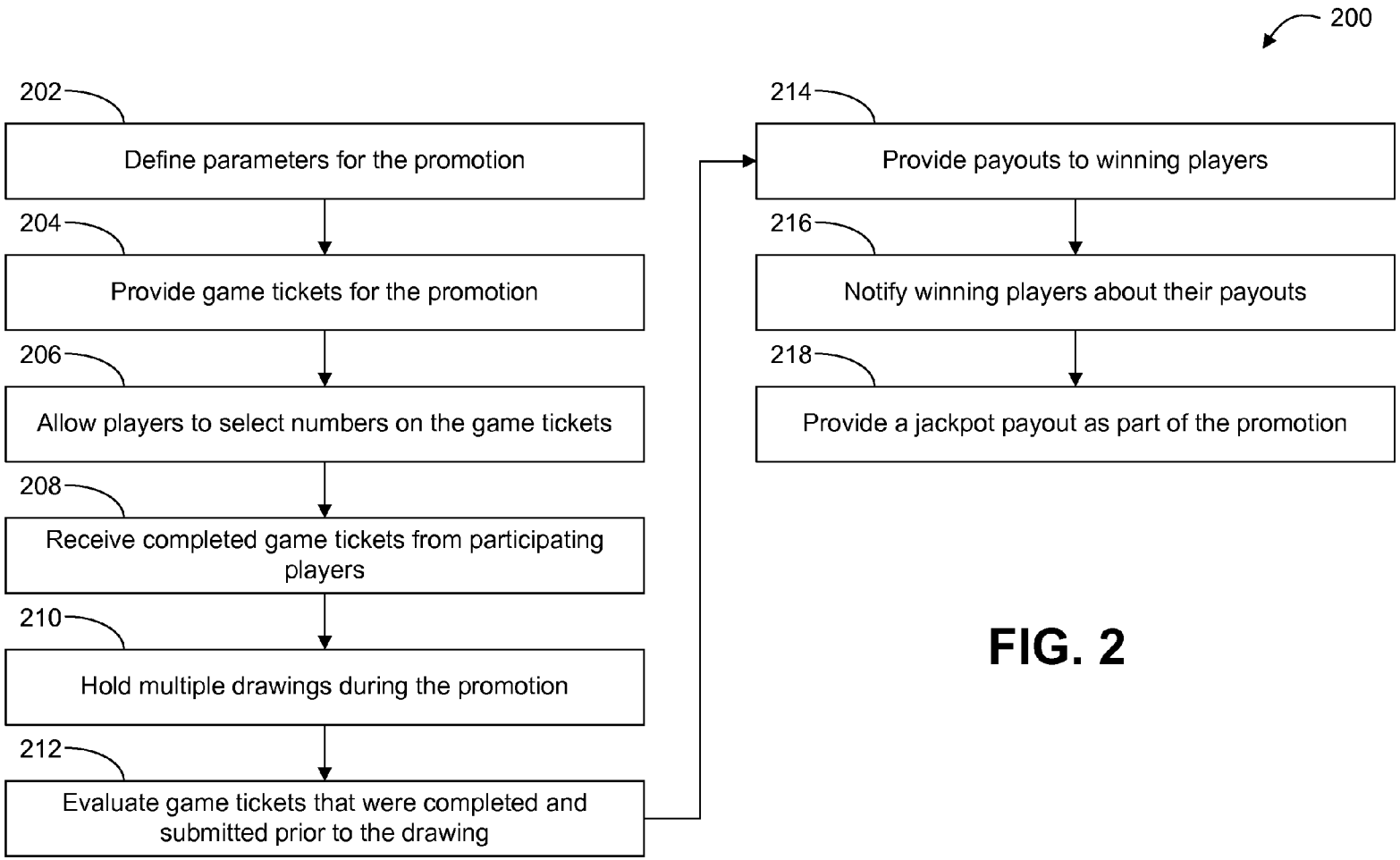
FIG. 2 illustrates a method for implementing a promotion that utilizes a Keno-type wagering game concept as disclosed herein.

FIG. 2 illustrates a method 200 for implementing a promotion that utilizes a Keno-type wagering game concept as disclosed herein. The method 200 may involve defining certain parameters for the promotion. Some examples of parameters that may be defined 202 were provided above. The method 200 may also involve providing 204 game tickets for the promotion. As indicated above, game tickets may be in electronic form and may be displayed on a display screen of a slot machine 104, slot system marketing screen or on the slot system text line digital display. Alternatively, or in addition, game tickets may be printed on paper.

When the promotion starts, the method 200 may also involve allowing 206 players to select numbers on the game tickets. Players may be allowed to earn opportunities to select numbers on a game ticket via slot machine play. For example, a player may earn the opportunity to select one number on a game ticket each time that the player wagers a predefined amount on any of the slot machines 104 at the participating properties 102. Alternatively, or in addition, players may be allowed to purchase opportunities to select numbers on a game ticket. Players may be allowed to purchase such opportunities using cash, slot machine credits, reward credits (e.g., players club points), etc. The method 200 may also involve receiving 208 completed game tickets from players who are participating in the promotion.

During the promotion, multiple drawings may be held 210. In each drawing, a certain quantity of numbers may be chosen from among the numbers that appear on each of the game tickets. Whenever a drawing is held, the method 200 may also involve evaluating 212 game tickets that were completed and submitted prior to the drawing, and providing 214 payouts to winning players based on how closely the players' number selections on the game tickets match the numbers chosen in the drawing. Winning players may be notified 216 about their payouts.

The method 200 may also involve providing 218 a jackpot payout as part of the promotion. The jackpot payout may be provided to a player (or multiple players) whose number selections match all of the numbers that are chosen during a drawing. As indicated above, the jackpot payout may be progressive. For example, if no player correctly selects each of the numbers that are chosen in a particular drawing, then the amount of the jackpot for the next drawing may increase by a certain amount.

Figure 3:
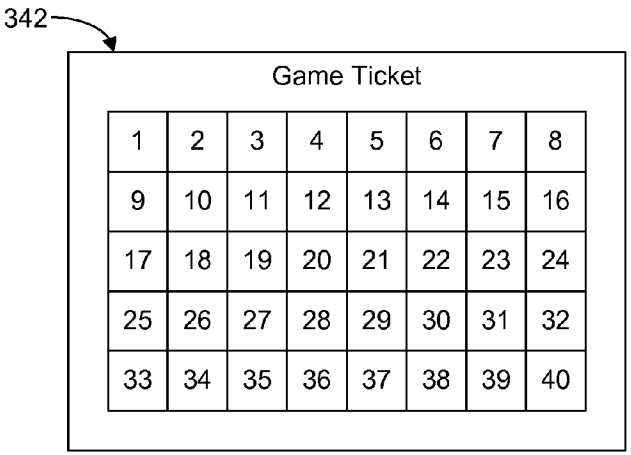
FIG. 3 illustrates an example of a game ticket that may be provided in connection with a Keno-type wagering game as disclosed herein.

FIG. 3 illustrates an example of a game ticket 342 that may be provided in connection with a Keno-type wagering game as disclosed herein. The game ticket 342 includes the numbers 1-40. Of course, the range of numbers shown in the depicted game ticket 342 is only exemplary; game tickets that include other ranges of numbers may be provided in connection with a Keno-type wagering game as disclosed herein.

The degree of difficulty of a particular Keno-type wagering game may depend, at least partially, on the range of numbers that are included in the game ticket 342. Typically, as the range of numbers increases, the degree of difficulty of the Keno-type wagering game also increases. As discussed above, before a promotion begins, one or more promotion administrators may define certain parameters for the promotion. The degree of difficulty of the games that are played during the promotion may be one of the parameters that is defined. The degree of difficulty may be increased by increasing the range of numbers in the game tickets 342 that are provided for the promotion. Conversely, the degree of difficulty may be decreased by decreasing the range of numbers in the game tickets 342 that are provided for the promotion.

Figure 4:
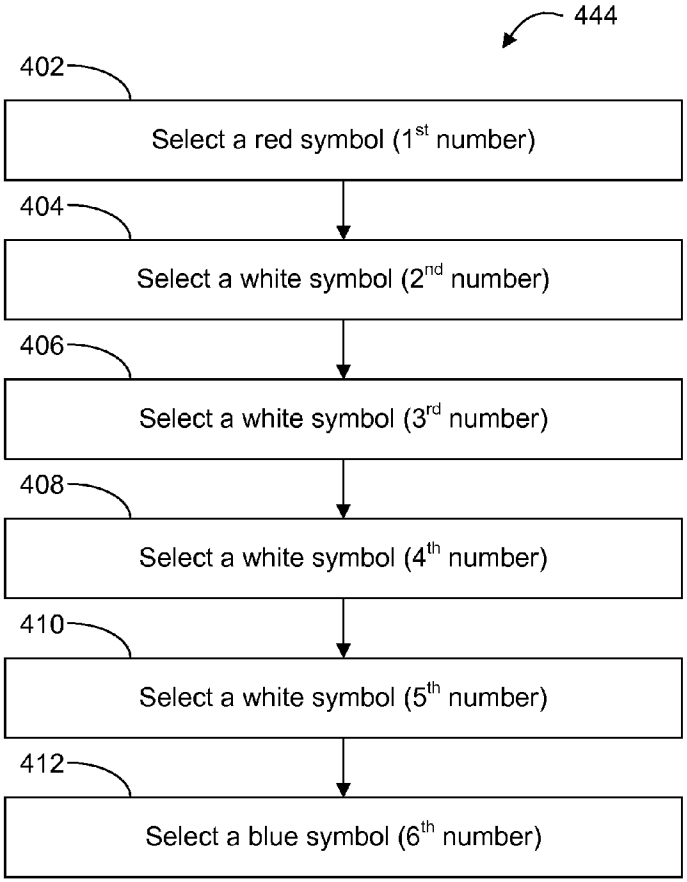
FIG. 4 illustrates an example of a drawing that may be held in connection with a Keno-type wagering game as disclosed herein.

FIG. 4 illustrates an example of a drawing 444 that may be held in connection with a Keno-type wagering game as disclosed herein. In this example, six numbers are chosen in the drawing. Each number may be chosen by selecting a numbered symbol having a particular color. Many different kinds of symbols may be used. An example of a symbol that may be used is a ball.

The first number may be chosen by selecting 402 a special designated number (red symbol) from among multiple special designated numbers (red symbols). The range of the numbered red symbols may correspond to the range of numbers on the game tickets 342 that were provided and completed by players. For example, if the game tickets 342 each included the numbers 1-40, then the first symbol may be selected from among 40 red symbols numbered 1-40, respectively.

The second number may be chosen by selecting 404 a white symbol from among multiple numbered white symbols. The range of the numbered white symbols may also correspond to the range of numbers on the game tickets 342 that were provided and completed by players. The third, fourth and fifth numbers may be chosen in the same manner as the second number was chosen, namely by selecting 406, 408, 410 white symbols from among the multiple numbered white symbols.

The sixth number may be chosen by selecting 412 a blue symbol from among multiple numbered blue symbols. The range of the numbered blue symbols may also correspond to the range of numbers on the game tickets 342 that were provided and completed by players.

In this example, symbols having different colors are used to distinguish bonus numbers from non-bonus numbers, and to distinguish different types of bonus numbers from one another in the drawing 444. The colors used in this example are exemplary only. Other colors may be utilized. Moreover, it is not necessary for symbols having different colors to be utilized. Other ways for distinguishing the bonus numbers from non-bonus numbers, and to distinguish different types of bonus numbers from one another, may be utilized.

Figure 5:
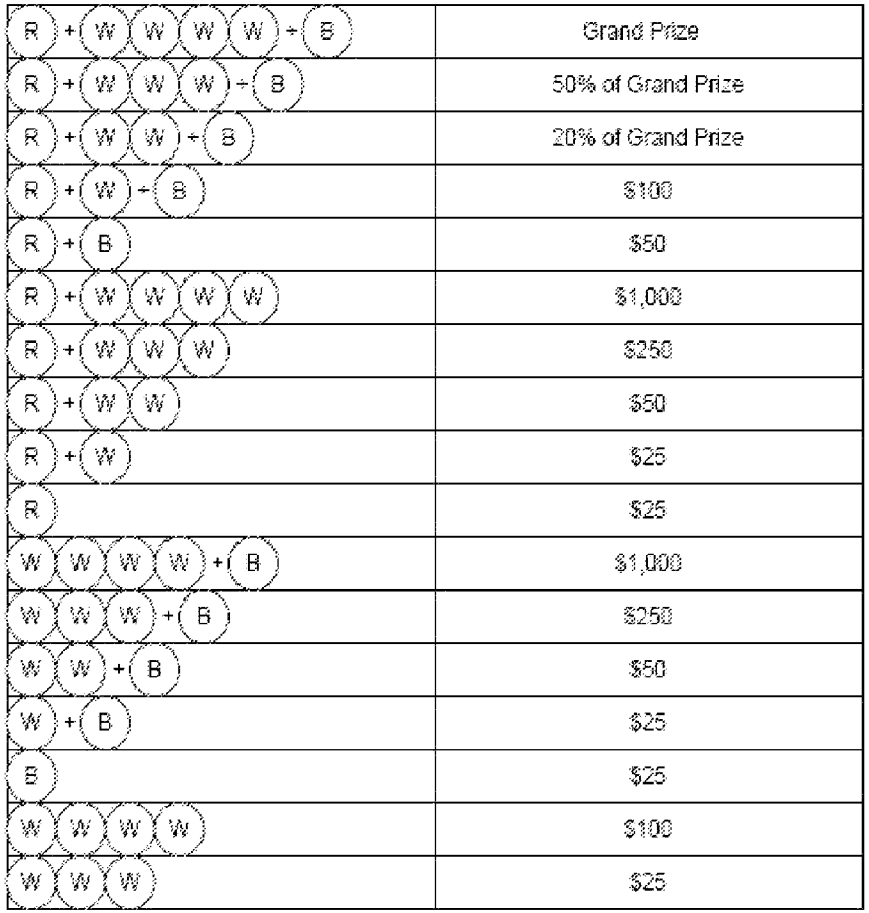
FIG. 5 illustrates an example of a payout table that may be defined for a Keno-type wagering game as disclosed herein.

FIG. 5 illustrates an example of a payout table 546 that may be defined for a Keno-type wagering game as disclosed herein. The depicted payout table 546 may be used in connection with the drawing 444 described above in relation to FIG. 4. The depicted payout table 546 provides that a player wins a grand prize (e.g., the jackpot prize referred to above) if all N of the numbers that the player has selected on his/her game ticket 342 match the N numbers that were chosen during the drawing 444. The payout table also provides for smaller prizes to be awarded to players who selected some, but not all, of the N numbers that were chosen during the drawing 444.

In accordance with the depicted payout table 546, the first number that is chosen in the drawing 444 (i.e., the red symbol) and the last number that is chosen in the drawing 444 (i.e., the blue symbol) are both bonus numbers. In the depicted payout table 546, these numbers are more valuable than the other numbers that are chosen. Any player who has correctly selected the first number that is chosen during the drawing 444 or the last number that is chosen during the drawing 444 is automatically a winner, even if none of the other numbers that were selected by the player match any of the other numbers that were chosen during the drawing 444.

In the depicted payout table 546, the symbols are shown as balls. However, as indicated above, many different kinds of symbols may be used in accordance with embodiments disclosed herein.

Although there were two bonus numbers in the example that was just discussed, a different quantity of bonus numbers may be provided. Also, it is not necessary that the bonus numbers be the first and/or the last numbers that are chosen as part of the drawing 444. Bonus numbers and non-bonus numbers for a particular drawing 444 may be chosen in any desired order.

FIG. 5A illustrates another example of a payout table 546A that may be defined for a Keno-type wagering game as disclosed herein. The depicted payout table 546A may be used in connection with the drawing 444 described above in relation to FIG. 4. The payout table 546A shown in FIG. 5A includes information for various possible winning scenarios. The information that is shown for each possible winning scenario includes the probability that the winning scenario will occur, the prize associated with the winning scenario, and other information. The depicted payout table 546A provides that a player wins a grand prize if all N of the numbers that the player has selected on his/her game ticket 342 match the N numbers that were chosen during the drawing 444. The payout table 546A also provides for smaller prizes to be awarded to players who selected some, but not all, of the N numbers that were chosen during the drawing 444.

In order to assist a promotion administrator to define a promotion, a spreadsheet that is similar to the depicted payout table 546A may be created. Such a spreadsheet may allow a user to change the quantity of numbers that is selected in a drawing 444, the quantity of numbers that is provided on each game ticket 342, and the amounts of the prizes that are provided for the various winning scenarios. The spreadsheet may be configured to automatically recalculate other information shown in the payout table 546A in response to the these parameters being changed. This may assist a promotion administrator to define the amounts of the prizes for the various winning scenarios in an optimal manner.

Figure 6:
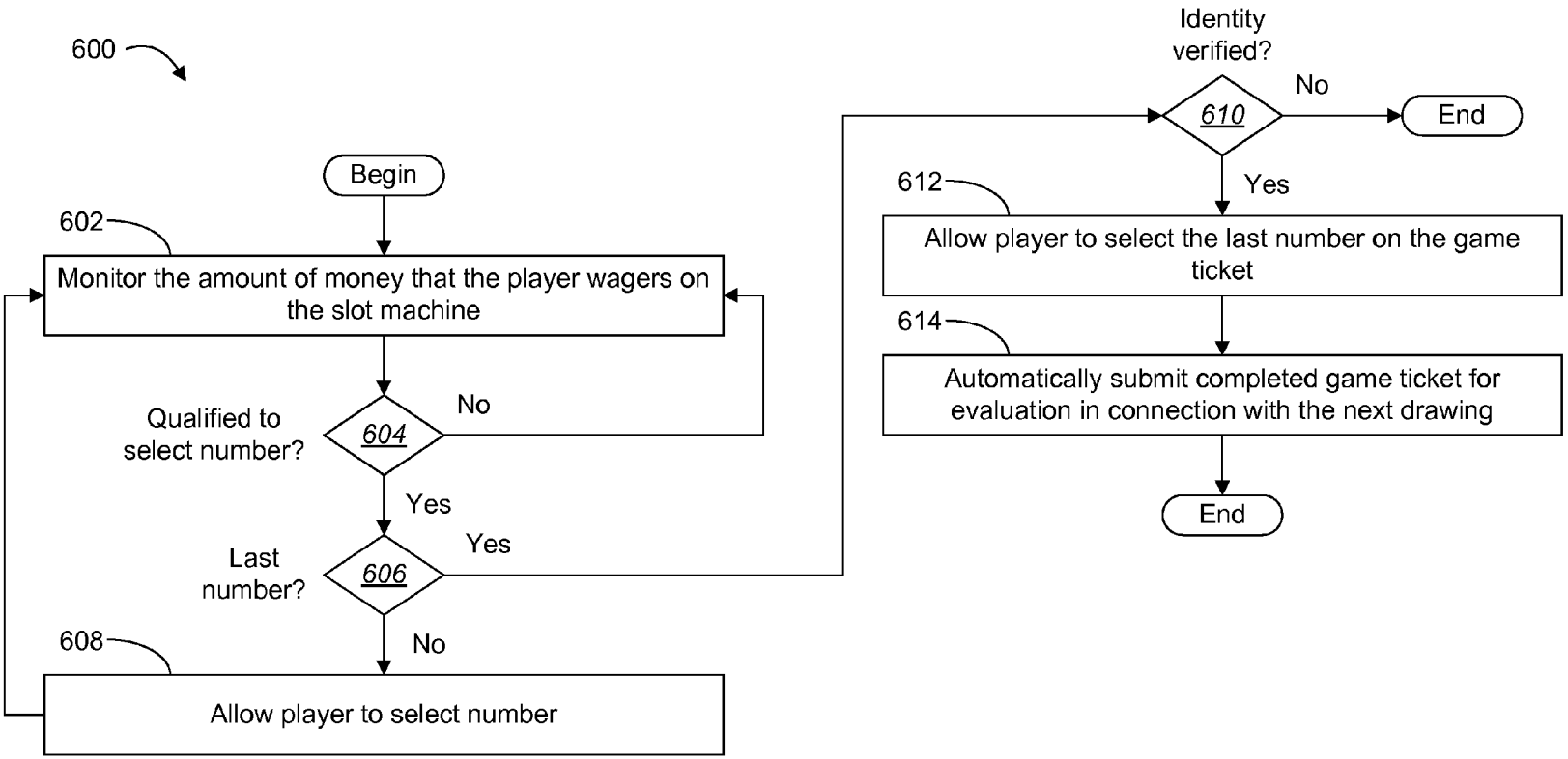
FIG. 6 illustrates a method for allowing players to earn opportunities to select numbers on a game ticket via slot machine play.

FIG. 6 illustrates a method 600 for allowing players to earn opportunities to select numbers on a game ticket 342 via slot machine play. The method 600 may be performed by the game ticket completion component 120 shown in the system 100 of FIG. 1. For clarity, the method 600 will be described in relation to a single player who is playing on a single slot machine 104. However, during a promotion that utilizes a Keno-type wagering game as described herein, the method 600 may be performed for each player who plays on one or more slot machines 104 at properties 102 that are participating in the promotion.

A player may be provided with an opportunity to select a number on his/her game ticket 342 after wagering a certain amount of money. When a player begins to play on a slot machine 104, the amount of money that the player wagers on the slot machine 104 may be monitored 602. From time to time, a determination may be made 604 about whether the player has wagered enough money to qualify to select a number on his/her game ticket 342. This determination may be made 604 each time that the player makes a new wager on the slot machine 104. Alternatively, this determination may be made 604 on a periodic basis.

When the player qualifies to select a number on his/her game ticket 342, then a determination may be made 606 about whether the next number that the player selects is the last number to be selected on the game ticket 342 (i.e., whether the next number will complete the player's game ticket 342). If the next number is not the last number to be selected, then the player may be allowed 608 to select a number on his/her game ticket 342, and the method 600 may involve continuing to monitor 602 the amount of money that the player wagers on the slot machine 104.

If it is determined 606 that the next number that the player selects will complete the player's game ticket 342, then the method 600 may involve attempting 610 to verify the identity of the player. For example, the player may be prompted to enter a security identifier (e.g., a personal identification number) that the organization that is conducting the promotion has in its records (e.g., in the central database 114 and/or the database 108 at a particular property 102). If the identity of the player is not verified, then the player may not be allowed to select the last number for the game ticket 342. However, if the identity of the player is verified, then the player may be allowed to select 612 the last number on his/her game ticket 342, thereby completing the game ticket 342. Once the player's game ticket 342 is completed, it may automatically be submitted 614 for evaluation in connection with the next drawing 444 that is held.

A player who has started to complete a game ticket 342 may stop playing on a slot machine 104 before fully completing a game ticket 342. When this happens, information about the partially completed game ticket 342 may be stored (e.g., in the central database 114 and/or the property-specific database 108) so that when the player resumes play, the player can continue completing the game ticket 342 where he/she previously left off. Some examples of information that may be stored include the numbers that were previously selected by the player, the amount that the player had wagered toward being able to select the next number, how close the player is to completing a game ticket 342, etc. At least some of the information that is stored may be displayed to the player when he/she resumes play. For example, suppose that a player had previously selected two numbers on a game ticket 342 and was a $10 wager away from being able to select another number. In this scenario, when the player resumes play, a message may be displayed to the player informing the player that he/she is only a $10 wager away from being able to select another number. Then the player may be allowed to select a third number on the game ticket 342 after wagering an additional $10.

Under some circumstances, it may be desirable to delete information about partially completed game tickets 342. This information may periodically (e.g., once a day) be deleted from all player accounts. Alternatively, this information may be deleted from certain player accounts that have been inactive for a defined amount of time (e.g., after a day without any new gaming activity).

Figure 7:
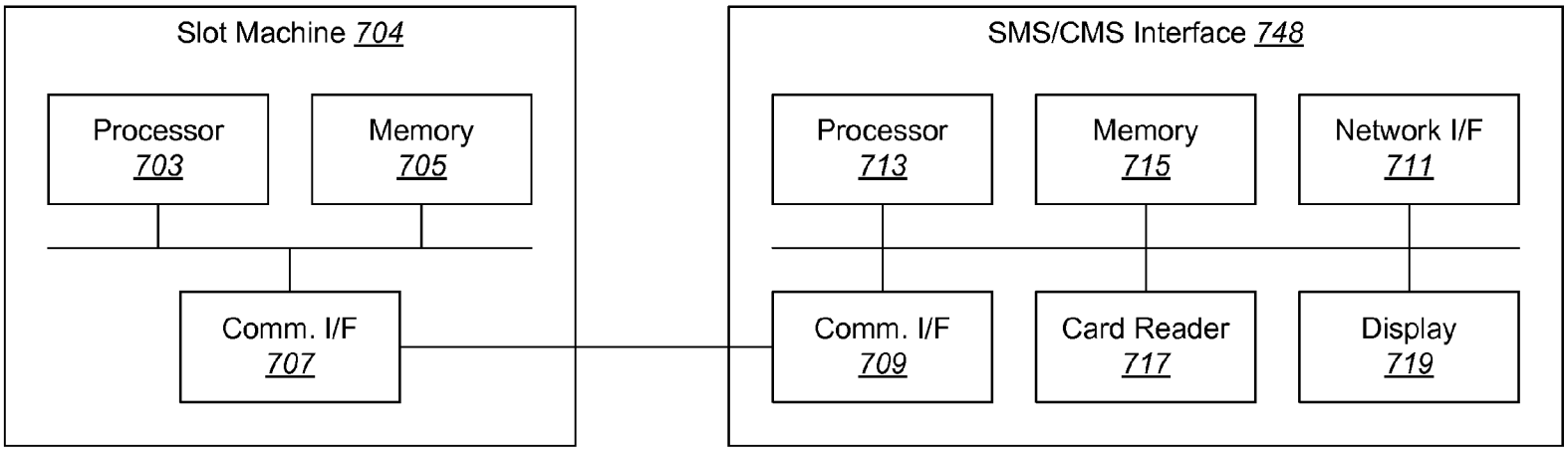
FIG. 7 illustrates an example of a slot machine configuration that may be utilized.

FIG. 7 illustrates an example of a slot machine configuration that may be utilized. A slot machine 704 is shown with a processor 703 and memory 705. The processor 703 may control the operation of the slot machine 704 and may be embodied as a microprocessor, a microcontroller, a digital signal processor (DSP) or other device known in the art. The processor 703 typically performs logical and arithmetic operations based on program instructions stored within the memory 705. The program instructions within the memory 705 may be executed by the processor 703 to implement the different types of games that may be played on the slot machine 704.

The slot machine 704 is also shown with a communication interface 707. The communication interface 707 may be used to communicate with an SMS/CMS interface component 748. The SMS/CMS interface component 748 may include a communication interface 709 for communicating with the slot machine 704. The SMS/CMS interface component 748 is also shown with a network interface 711, which may be used to communicate with an SMS/CMS system 106 via a network.

The SMS/CMS interface component 748 is also shown with a processor 713 and memory 715. The processor 713 may perform logical and arithmetic operations based on program instructions stored within the memory 715. The program instructions within the memory 715 may be executed by the processor 713 to implement various aspects of the methods described herein. Alternatively, these functions may be performed by an SMS/CMS system 106, and the SMS/CMS interface component 748 may simply provide signals to the SMS/CMS system 106 that are subsequently interpreted by the SMS/CMS system 106. Advantageously, it is not necessary to make any changes to the slot machine 704 itself to implement the methods described herein.

The SMS/CMS interface component 748 may also include a card reader 717. When a player begins playing on the slot machine 704, the player may insert a player tracking card into the card reader 717, and the card reader 717 may extract the player's unique player ID from the player tracking card. This may have the effect of identifying the player. The SMS/CMS interface component 748 may also include a display 719. The display 719 may be used to communicate information to the current player of the slot machine 704.

Information and signals may be represented using any of a variety of different technologies and techniques. For example, data, instructions, commands, information, signals and the like that may be referenced throughout the above description may be represented by voltages, currents, electromagnetic waves, magnetic fields or particles, optical fields or particles or any combination thereof.

The various illustrative logical blocks, modules, circuits and algorithm steps described in connection with the embodiments disclosed herein may be implemented as electronic hardware, computer software or combinations of both. To clearly illustrate this interchangeability of hardware and software, various illustrative components, blocks, modules, circuits and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as limiting the scope of the claims.

The various illustrative logical blocks, modules and circuits described in connection with the embodiments disclosed herein may be implemented or performed with a general purpose processor, a digital signal processor (DSP), an application specific integrated circuit (ASIC), a field programmable gate array signal (FPGA) or other programmable logic device, discrete gate or transistor logic, discrete hardware components or any combination thereof designed to perform the functions described herein. A general purpose processor may be a microprocessor, but in the alternative, the processor may be any conventional processor, controller, microcontroller or state machine. A processor may also be implemented as a combination of computing devices, e.g., a combination of a DSP and a microprocessor, a plurality of microprocessors, one or more microprocessors in conjunction with a DSP core or any other such configuration.

The steps of a method or algorithm described in connection with the embodiments disclosed herein may be embodied directly in hardware, in a software module executed by a processor or in a combination of the two. A software module may reside in any form of storage medium that is known in the art. Some examples of storage media that may be used include RAM memory, flash memory, ROM memory, EPROM memory, EEPROM memory, registers, a hard disk, a removable disk, a CD-ROM and so forth. A software module may comprise a single instruction, or many instructions, and may be distributed over several different code segments, among different programs and across multiple storage media. An exemplary storage medium may be coupled to a processor such that the processor can read information from, and write information to, the storage medium. In the alternative, the storage medium may be integral to the processor.

The methods disclosed herein comprise one or more steps or actions for achieving the described method. The method steps and/or actions may be interchanged with one another without departing from the scope of the claims. In other words, unless a specific order of steps or actions is required for proper operation of the embodiment that is being described, the order and/or use of specific steps and/or actions may be modified without departing from the scope of the claims.

While specific embodiments have been illustrated and described, it is to be understood that the claims are not limited to the precise configuration and components illustrated above. Various modifications, changes and variations may be made in the arrangement, operation and details of the embodiments described above without departing from the scope of the claims.

What is claimed is:

1. A method for implementing a Keno-type wagering game, comprising:

providing game tickets, wherein each game ticket comprises a plurality of numbers;

providing participating players with opportunities to select numbers on the game tickets based on the players' slot machine play, wherein providing a particular player with opportunities comprises determining whether the player has wagered enough money during the players' slot machine play to qualify to select a number on a game ticket;

displaying, on a display screen associated with a slot machine, information about how much, if any, the player must further wager on the slot machine play in order to select the next number on the game ticket;

receiving completed game tickets from the participating players, wherein each completed game ticket comprises a player selection of a certain quantity of the plurality of numbers;

holding a drawing on a computer in which multiple numbers are chosen; and providing payouts to winning players based on how closely the players' number selections on the game tickets match the numbers chosen in the drawing, wherein at least one number chosen in the drawing is a bonus number that has greater payout value than other numbers chosen in the drawing, wherein a greater payout is provided for correctly selecting the bonus number than for correctly selecting two or more of the other numbers, wherein the amount of the payouts are displayed on the computer, wherein the opportunities to select numbers on the game tickets is based only on the amounts wagered during the players' slot machine play.

2. The method of claim 1, wherein the same quantity of numbers is chosen in the drawing and selected by the participating players on the completed game tickets.

3. The method of claim 1, wherein two numbers in the drawing are bonus numbers.

4. The method of claim 1, wherein the wagering game is played as a live Keno game.

5. The method of claim 1, wherein the wagering game is played on a standalone slot machine.

6. The method of claim 1, wherein the wagering game is played as a live table game.

7. The method of claim 1, wherein a particular player is provided with opportunities to select a number on the game ticket independent of whether or not the player wins money on the slot machine.

8. A method for using a Keno-type wagering game as part of a promotion for slot machine players, comprising:

providing game tickets for the promotion, wherein each game ticket comprises a plurality of numbers;

providing participating players with opportunities to select numbers on the game tickets based on the players' slot machine play, wherein providing a particular player with opportunities comprises determining whether the player has wagered enough money during the players' slot machine play to qualify to select a number on a game ticket;

displaying, on a display screen associated with a slot machine, information about how much, if any, the player must further wager on the slot machine play in order to select the next number on the game ticket;

receiving completed game tickets from the participating players, wherein each completed game ticket comprises a player selection of a certain quantity of the plurality of numbers;

holding multiple drawings on a computer, wherein in each drawing multiple numbers are chosen; and providing payouts to winning players based on how closely the players' number selections on the game tickets match the numbers chosen in the drawings, wherein in each drawing at least one bonus number is chosen that has greater monetary payout value than other numbers chosen in that drawing, wherein a greater payout is provided for correctly selecting the bonus number than for correctly selecting two or more of the other numbers, wherein the amount of the payouts are displayed on the computer, wherein the opportunities to select numbers on the game tickets is based only on the amounts wagered during the players' slot machine play.

9. The method of claim 8, further comprising allowing players to purchase opportunities to select numbers on the game tickets using cash or slot machine credits.

10. The method of claim 8, further comprising allowing players to purchase opportunities to select numbers on the game tickets using reward credits.

11. The method of claim 8, wherein the quantity of numbers chosen in each drawing is the same as the quantity of numbers that was selected by the participating players on the completed game tickets.

12. The method of claim 8, wherein two numbers in each drawing are bonus numbers.

13. The method of claim 8, further comprising providing a jackpot payout as part of the promotion, wherein the jackpot payout is provided to at least one player whose number selections match all of the numbers that are chosen during a drawing.

14. The method of claim 13, wherein the jackpot payout is progressive.

15. The method of claim 8, further comprising notifying the winning players about their payouts.

16. The method of claim 8, wherein the payouts comprise a mixture of non-cashable credits, cashable credits, and hand-paid funds.

17. The method of claim 8, further comprising allowing one or more promotion administrators to define promotion parameters.

18. The method of claim 8, wherein the promotion is implemented across multiple properties.

19. The method of claim 8, further comprising requiring a player to enter a security identifier after the player has selected multiple numbers but before the player is allowed to select the last number of a game ticket, wherein entering a security identifier is always required before the player is allowed to select the last number.

20. The method of claim 8, further comprising:

storing information on the computer about a game ticket that a player has partially completed; and when the player resumes play, allowing the player to continue completing the game ticket.

21. The method of claim 8, further comprising periodically deleting information about partially completed game tickets, wherein the deleting is performed by the computer.

22. A computer system that is configured to use a Keno-type wagering game as part of a promotion for slot machine players, the computer system comprising:

a processor;

memory in electronic communication with the processor;

instructions stored in the memory, the instructions being executable to:

provide game tickets for the promotion, wherein each game ticket comprises a plurality of numbers;

provide participating players with opportunities to select numbers on the game tickets based on the players' slot machine play, wherein providing a particular player with opportunities comprises determining whether the player has wagered enough money during the players' slot machine play to qualify to select a number on a game ticket;

display, on a display screen associated with a slot machine, information about how much, if any, the player must further wager on the slot machine play in order to select the next number on the game ticket;

receive completed game tickets from the participating players, wherein each completed game ticket comprises a player selection of a certain quantity of the plurality of numbers;

hold multiple drawings, wherein in each drawing multiple numbers are chosen; and provide payouts to winning players based on how closely the players' number selections on the game tickets match the numbers chosen in the drawings, wherein in each drawing at least one bonus number is chosen that has greater monetary payout value than other numbers chosen in that drawing, wherein a greater payout is provided for correctly selecting the bonus number than for correctly selecting two or more of the other numbers, wherein the opportunities to select numbers on the game tickets is based only on the amounts wagered during the players' slot machine play.

* * * * *